US007980175B2

(12) United States Patent
Schönert et al.

(10) Patent No.: US 7,980,175 B2
(45) Date of Patent: Jul. 19, 2011

(54) APPARATUS AND METHOD FOR MEASURING ZONAL INKING

(75) Inventors: Michael Schönert, Augsburg (DE); Alfons Schuster, Augsburg (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 595 days.

(21) Appl. No.: 11/356,861

(22) Filed: Feb. 17, 2006

(65) Prior Publication Data

US 2006/0185549 A1 Aug. 24, 2006

(30) Foreign Application Priority Data

Feb. 19, 2005 (DE) ..... 10 2005 007 780

(51) Int. Cl.

| | |
|---|---|
| ***B41F 31/02*** | (2006.01) |
| ***B41F 1/54*** | (2006.01) |
| ***B41F 1/66*** | (2006.01) |
| ***B41L 5/12*** | (2006.01) |
| ***B41L 39/00*** | (2006.01) |
| ***B41L 47/56*** | (2006.01) |

(52) U.S. Cl. ..... 101/365; 101/484; 101/DIG. 47

(58) Field of Classification Search ..... 101/365, 101/484, DIG. 47

See application file for complete search history.

(56) References Cited

U.S. PATENT DOCUMENTS

| | | | | | |
|---|---|---|---|---|---|
| 4,488,808 | A | * | 12/1984 | Kato | 356/73 |
| 4,859,062 | A | | 8/1989 | Thurn et al. | |
| 4,947,348 | A | * | 8/1990 | Van Arsdell | 358/1.9 |
| 5,170,711 | A | * | 12/1992 | Maier et al. | 101/365 |
| 5,187,376 | A | * | 2/1993 | Hashimoto et al. | 250/559.02 |
| 5,559,909 | A | * | 9/1996 | Anderson et al. | 385/16 |
| 5,600,739 | A | * | 2/1997 | Anderson et al. | 385/16 |
| 5,623,563 | A | * | 4/1997 | Anderson et al. | 385/16 |
| 5,791,251 | A | * | 8/1998 | Kistler et al. | 101/484 |
| 5,926,588 | A | * | 7/1999 | Murakami et al. | 385/16 |
| 5,940,553 | A | * | 8/1999 | Murakami et al. | 385/22 |
| 5,947,029 | A | * | 9/1999 | Loeffler et al. | 101/484 |

(Continued)

FOREIGN PATENT DOCUMENTS

| | | |
|---|---|---|
| DE | 30 37 622 | 4/1982 |

(Continued)

OTHER PUBLICATIONS

German Office Action dated Dec. 5, 2005 issued in corresponding application No. 10 2005 007 780.3.

*Primary Examiner* — Daniel J Colilla
*Assistant Examiner* — Leo T Hinze
(74) *Attorney, Agent, or Firm* — Cohen Pontani Lieberman & Pavane LLP

(57) ABSTRACT

An apparatus for measuring zonal inking on a printed product having a plurality of inking zones includes a plurality of optical sensors, each of the optical sensors picking up signals from at least one zonal measurement region assigned to a respective one of the plurality of inking zones of the printed product. The apparatus also includes at least one optical switch connected for receiving the picked up signals from the plurality of optical sensors and at least one measurement device connected to the at least one optical switch for receiving the picked up signals and evaluating the picked up signals.

7 Claims, 4 Drawing Sheets

U.S. PATENT DOCUMENTS

| | | | | |
|---|---|---|---|---|
| 5,957,049 | A * | 9/1999 | Ammeter et al. | 101/211 |
| 6,028,682 | A * | 2/2000 | Ott et al. | 358/497 |
| 6,041,708 | A * | 3/2000 | Kipphan et al. | 101/365 |
| 6,119,594 | A * | 9/2000 | Kipphan et al. | 101/365 |
| 6,469,804 | B1 * | 10/2002 | Ott et al. | 358/1.9 |
| 6,631,677 | B1 * | 10/2003 | Fuhrmann et al. | 101/181 |
| 6,679,171 | B2 * | 1/2004 | Mayer et al. | 101/484 |

FOREIGN PATENT DOCUMENTS

| | | |
|---|---|---|
| DE | 31 48 076 | 6/1983 |
| DE | 32 18 166 | 11/1983 |
| DE | 195 11 782 | 10/1996 |
| EP | 0 686 861 | 12/1995 |
| EP | 0 729 050 | 8/1996 |

* cited by examiner

APPARATUS AND METHOD FOR MEASURING ZONAL INKING

BACKGROUND OF THE INVENTION

The present invention relates to an apparatus and a method for measuring zonal inking on printed products.

A printing material is moved successively through a plurality of printing units of a press during a printing operation and a printing ink is applied to the printing material in each printing unit. A separate printing unit and corresponding inking unit is provided for each printing ink. The inking unit of each printing unit has an ink metering device, the ink metering device comprising a number of inking zone setting elements, which are also designated ink slides or ink blades, corresponding to the number of inking zones to be printed on the printing material. A quantity of printing ink passes to an ink fountain roll or a ductor roll of the inking unit in each inking zone as a function of the respective inking zone setting element. The quantity of ink passed onto the ductor roll is transferred by a ductor roll or film roll onto an inking unit roll arranged downstream of the doctor roll or film roll and, via further inking unit rolls, is moved in the direction of a forme cylinder or plate cylinder of the respective printing unit. A transfer cylinder or rubber-covered cylinder interacts with the forme cylinder to transfer the printing ink from the forme cylinder to the printing material.

From the prior art, it is already known to measure the zonal inking established on the printing material during printing and, depending on this measurement, to control the zonal inking of the inking units involved in the printing. For this purpose, measurement regions are generally printed outside a subject on the printing material are measured. However, it is also possible for measurement regions within the subject to be measured. The measurement regions are also referred to as print control elements.

Measuring devices which are based on a densitometric and/or calorimetric and/or spectral measuring principle are used to measure the zonal inking. According to the prior art, in this case each inking zone of a printed product to be measured is either assigned an individual, stationary measuring device or there is a common measuring device for a plurality or all of the inking zones, which is moved in a traversing manner along the printed product to be measured. Stationary or static apparatuses for measuring the zonal inking, which have a separate measuring device for each inking zone, permit fast measurement of a printed product but are expensive because of the high expenditure on hardware. Traversing apparatuses for measuring the zonal inking, which have only one measuring device moved along the inking zones, are less expensive but need a longer time to measure a printed product.

SUMMARY OF THE INVENTION

An object of the present invention is to provide an apparatus and method for measuring the zonal inking which overcomes the problems of the prior art.

The object is met by an apparatus for measuring the zonal inking including a large number of optical sensors, which in each case pick up signals from at least one zonal measurement region and pass them on to a measuring device for evaluation. The optical sensors pass on or feed the picked up signals to a common measuring device with the interposition of at least one optical switch. The measuring device evaluates the signals provided by the optical sensors with a time offset or one after another.

The apparatus according to the invention for measuring the zonal inking of a printed product combines the advantages of the apparatuses known from the prior art. Because there are a large number of optical sensors, the apparatus according to the present invention permits fast measurement of the printed product. The fact that a plurality of optical sensors are connected to one measuring device also reduces the expenditure on hardware, so that the apparatus according to the invention is also implemented cost-effectively.

According to an embodiment of the present invention, the optical switches are constructed as multiplexers which, with the effect of time multiplexing, pass on the signals supplied to the respective multiplexer with a time offset to a device connected downstream of the respective multiplexer.

The object of the present invention is also met by a method for measuring the zonal inking, wherein signals from zonal measurement regions on a printed product are picked up by a large number of optical sensors and passed on to a common measuring device with the interposition of at least one optical switch, to evaluate the signals provided by the optical sensors.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings, wherein like reference characters denote similar elements throughout the several views.

DETAILED DESCRIPTION OF THE PRESENTLY PREFERRED EMBODIMENTS

Figure 1:
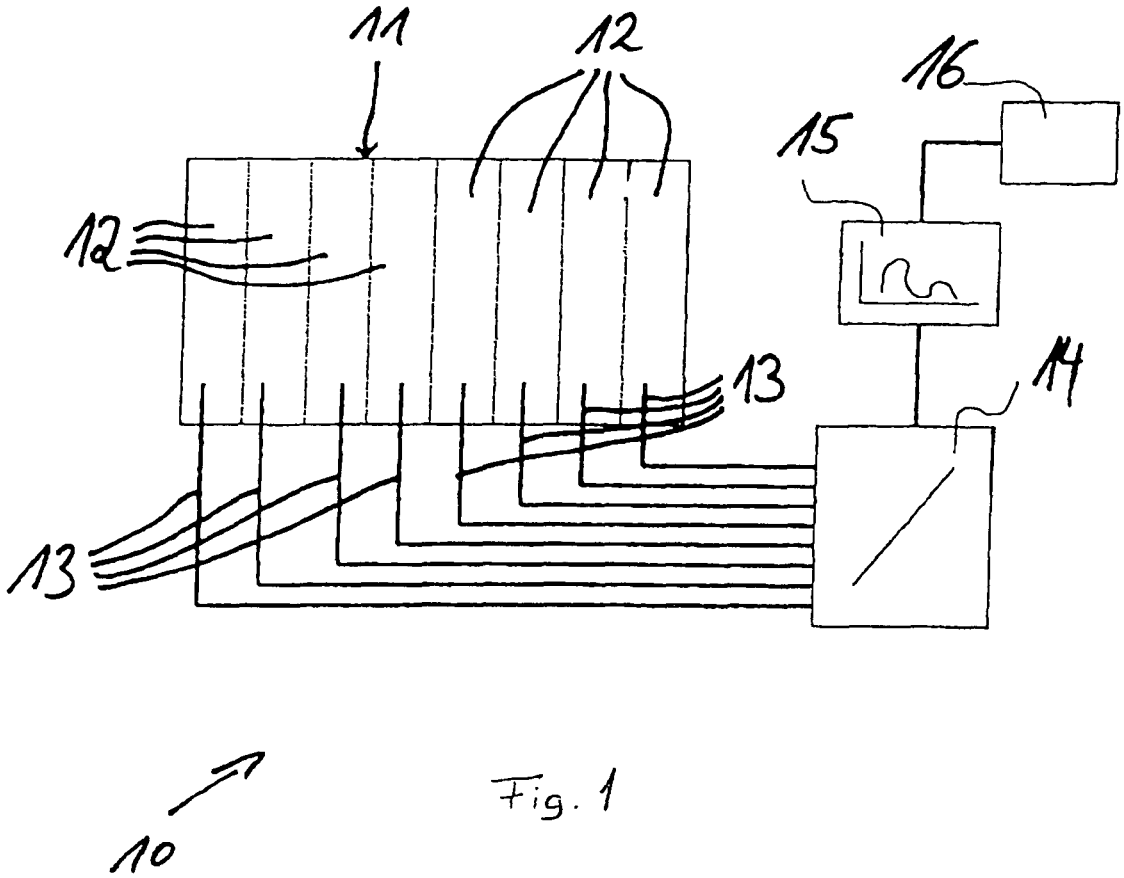
FIG. 1 is a schematic diagram of an apparatus for measuring zonal inking on a printed product according to a first embodiment of the present invention.

FIG. 1 shows an apparatus 10 for measuring the zonal inking on a printed product 11 according to a first embodiment of the present invention. In FIG. 1, the printed product 11 to be measured has a total of eight inking zones 12. With the aid of the apparatus 10 according to the invention, at least one measured value relating to the zonal inking in the inking zones 12 is to be determined for each of the inking zones 12. For this purpose, measurement regions assigned to the inking zones 12 are measured. The measurement regions may be within or outside of a printed subject on the printed product.

In the embodiment of FIG. 1, each inking zone 12 is assigned to an optical sensor 13. With the aid of the optical sensors 13, optical signals from at least one measurement region to be measured can be picked up for each inking zone 12. All the optical sensors 13 are connected to a common optical switch 14. The signals picked up by the optical sensors 13 are supplied to the optical switch 14 as input signals, the optical switch 14 always supplying only one of these input signals to a measuring device 15 connected downstream of the optical switch 14. In the measuring device 15, the optical signals picked up by the optical sensors 13 are evaluated densitometrically and/or calorimetrically and/or spectrally and corresponding measured values are supplied to a control device 16, which can use the measured values to regulate the zonal inking.

The optical switch 14 is constructed as an optical multiplexer which, with the effect of time multiplexing, passes on the signals supplied to the multiplexer 14 by the optical sensors 13 with a time offset to the measuring device 15 connected downstream of the multiplexer 14. In this way, optical signals can be picked up simultaneously in all the inking zones and supplied with a time offset to the single measuring device 15. By this means, fast measurement of the zonal inking over the entire printed product 11, specifically over all the inking zones 12 of the printed product, can be implemented with little expenditure on hardware.

Figure 2:
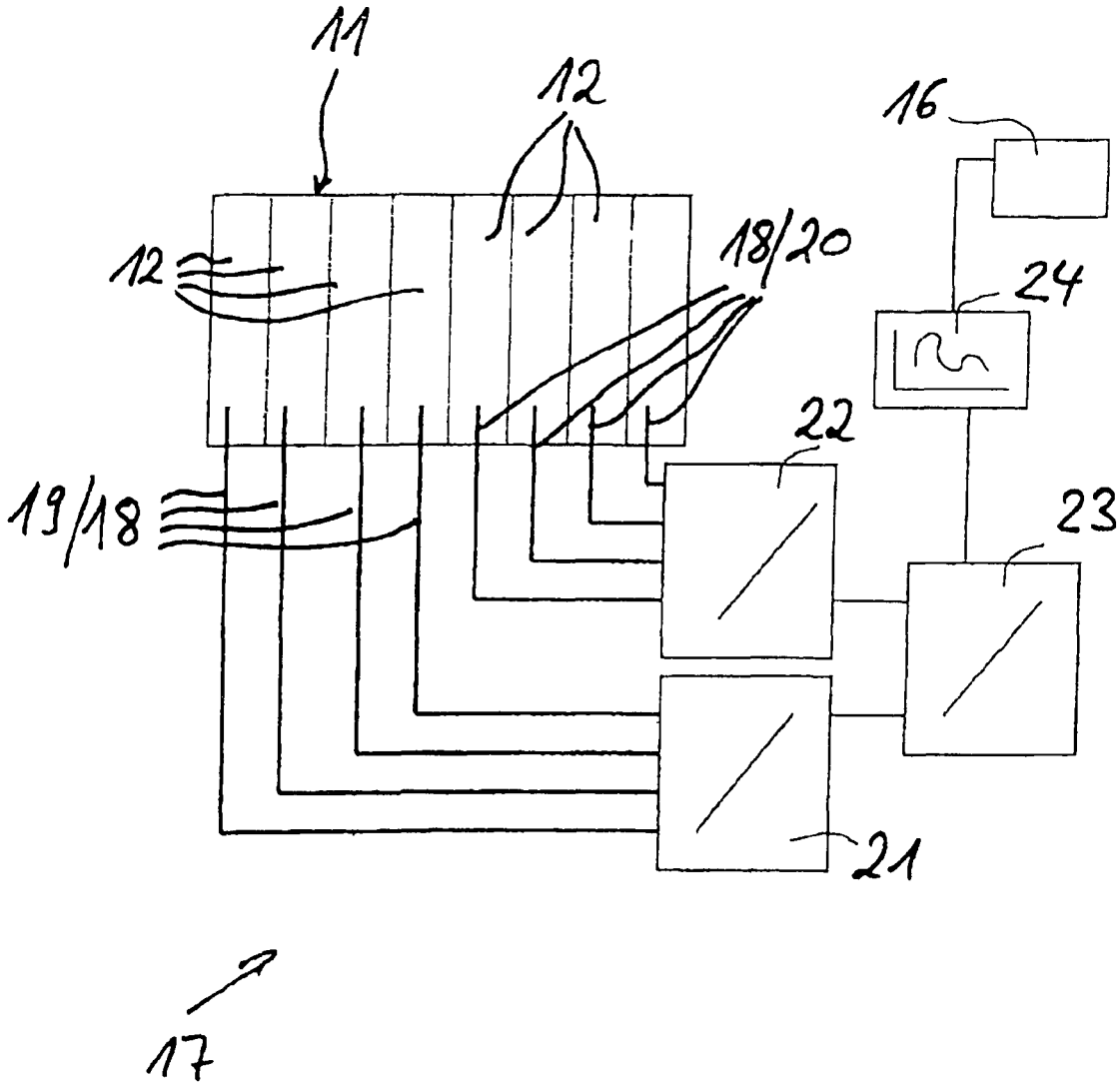
FIG. 2 is a schematic diagram of an apparatus for measuring zonal inking according to a second embodiment of the present invention.

A second embodiment shown in FIG. 2 includes an apparatus 17 for measuring the zonal inking on the printed product 11. In this embodiment, the printed product 11 again has a total of eight inking zones 12 and each inking zone 12 is again assigned a separate optical sensor 18. The optical sensors 18 form two groups 19 and 20, wherein each of the groups 19 and 20 of optical sensors 18 is connected to a respective optical switch 21 and 22. The optical signals picked up by the optical sensors 18 are supplied to the optical switches 21 and 22 connected to the same as input signals. The two optical switches 21 and 22 supply the picked up signals to an optical switch 23 connected downstream of the two optical switches. The optical switch 23 is connected to the optical switches 21 and 22 with the effect of a cascade circuit. The optical signals picked up by the optical sensors 18 are passed on with a time offset from the optical switch 23 to a measuring device 24, which performs densitometric and/or calorimetric and/or spectral evaluation of the signals. The control device 16 regulates the zonal inking on the basis of the measured signals provided by the measuring device 24.

In both the apparatus 17 in FIG. 2 and the apparatus 10 in FIG. 1, only a single measuring device 15 or 24 is used for evaluation of all the optical signals picked up by the optical sensors 13 or 18. In the embodiment of FIG. 1, all the optical sensors 13 are connected to a single optical switch 14. In the embodiment of FIG. 2, the optical sensors 18 are combined into groups 19 and 20, wherein each of the groups 19 and 20 is connected to a respective optical switch 21 or 22, the optical signals being supplied from the optical switches 21 and 22 to the single measuring device 24 with the interposition of a further optical switch 23.

Figure 3:
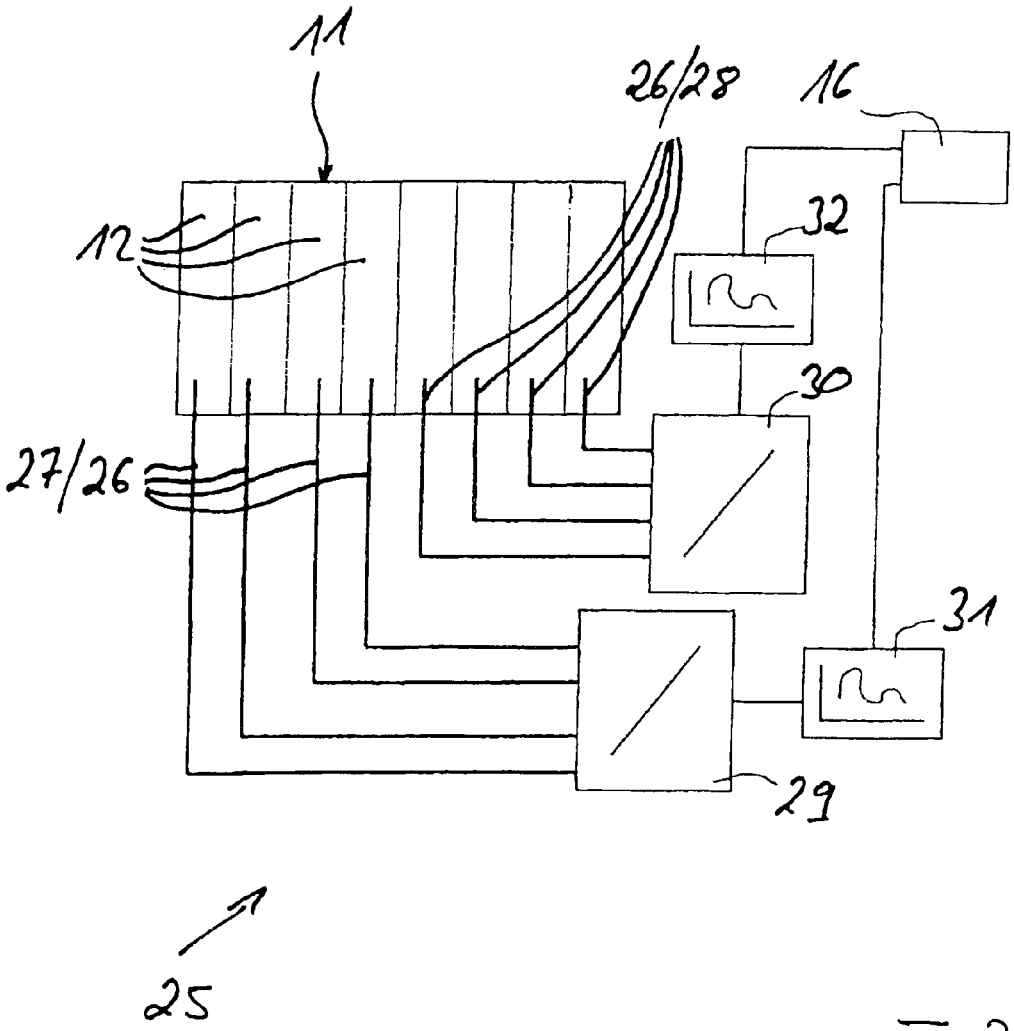
FIG. 3 is a schematic diagram of an apparatus for measuring zonal inking according to a third embodiment of the present invention.

A third embodiment including an apparatus 25 for measuring the zonal inking on the printed product 11 which has eight inking zones 12 is shown in FIG. 3. In the embodiment of FIG. 3, each of the inking zones 12 is assigned to a respective one of optical sensors 26, wherein the optical sensors are structured in groups 27 and 28. The measuring sensors 26 of each group 27 and 28 are connected to a respective optical switch 29 or 30. To this extent, the embodiment of FIG. 3 coincides with the embodiment of FIG. 2. However, in the embodiment of FIG. 3, a measuring device 31 and 32, respectively, is connected downstream of each of the optical switches 29 or 30 assigned to a group 27 or 28, in which measuring device the optical signals picked up by the optical sensors 26 of the respective groups 27 and 28 are evaluated densitometrically and/or calorimetrically and/or spectrally. Measured values from the measuring devices 31 and 32 are supplied to the control device 16.

Figure 4:
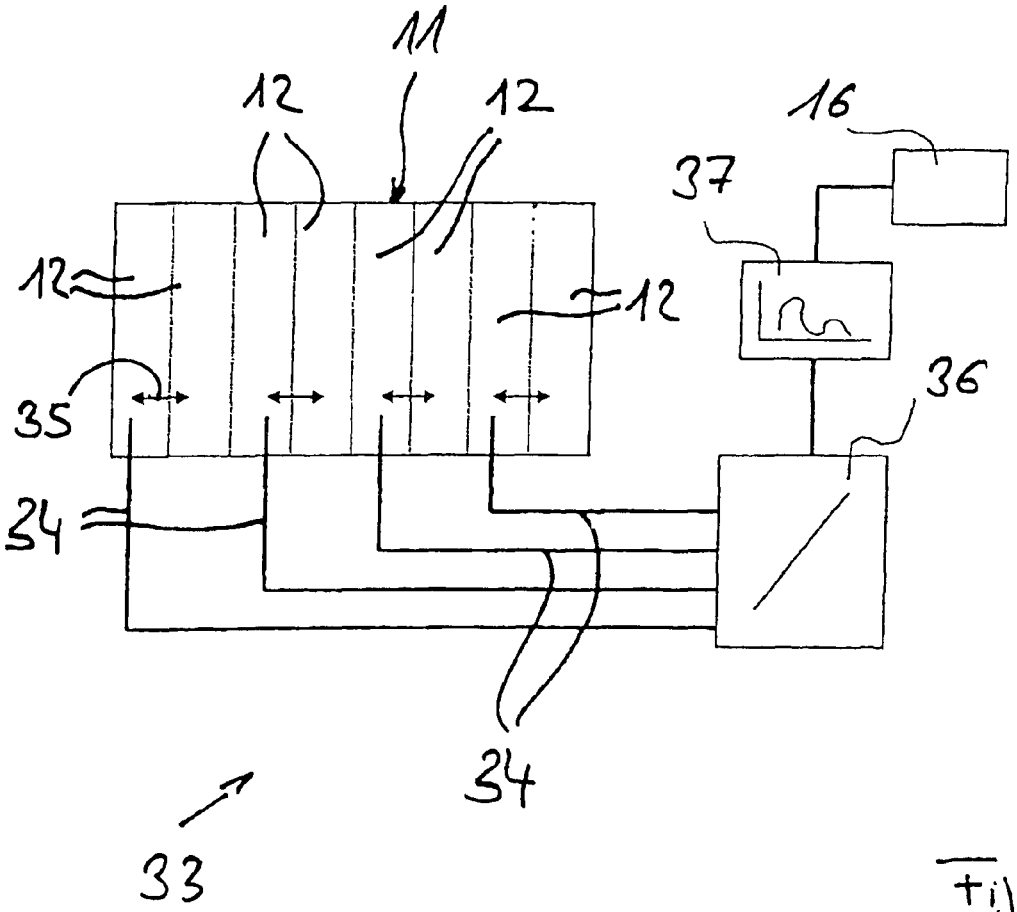
FIG. 4 is a schematic diagram of an apparatus for measuring zonal inking according to a further embodiment of the present invention.

A further embodiment including an apparatus 33 for measuring the zonal inking on the printed product 11 having eight inking zones 12, is shown in FIG. 4. The apparatus 33 includes a plurality of optical sensors 34, wherein each of the optical sensors 34 is assigned to two inking zones 12. By means of a traversing relative movement of the optical sensors 34 relative to the printed product 11 to be measured in the direction of the arrows 35, appropriate optical signals can be picked up by one optical sensor 34 on two adjacent ones of the inking zones 12. All the optical sensors 34 are connected to a single optical switch 36 which, with the effect of time multiplexing, supplies the signals picked up by the optical sensors 34 to a single measuring device 37. The measuring device 37 again evaluates the optical signals picked up by the optical sensors 34 densitometrically and/or calorimetrically and/or spectrally and provides corresponding measured values to the control device 16.

Figure 1A:
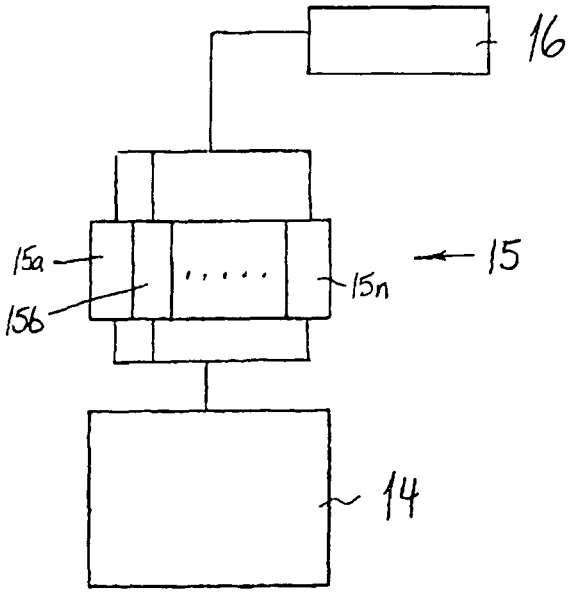
FIG. 1*a* is a schematic diagram of a measuring device of FIG. 1 according to a further embodiment.

Because of the spectral characteristics of the measuring device 15, it may be necessary to distribute the signal registered by the sensor 13 in a wavelength-dependent or wavelength-independent manner to a plurality of such measuring devices 15 and from there to supply it to the control device 16. For such a purpose, FIG. 1*a* shows that the measuring device 15 may comprise a plurality of subunits 15*a*, 15*b*, . . . 15*n* which cover different spectral ranges and are given this signal by an integrated optical switch, which distributes the input signal in a wavelength-dependent or wavelength-independent manner.

It is common to all the embodiments that signals picked up by a plurality of optical sensors are passed on to at least one measuring device for evaluation. Furthermore, the plurality of optical sensors pass on the picked up signals to the at least one common measuring device with the interposition of at least one optical switch. Further variations of the present invention beyond the embodiments shown in FIGS. 1 to 4 are conceivable. For example, optical sensors traversing over two, three or even four inking zones alternatively be used in the apparatuses according to FIGS. 2 and 3. Furthermore, it is obvious that the number of inking zones in a printed product to be measured is arbitrary.

The apparatus according to the present invention may be integrated into a press to measure the zonal inking of printed products automatically in or during the printing process and, on this basis, to regulate the zonal inking automatically. However, the measurement may also be performed outside the press. Finally, it should be pointed out that the optical sensors are preferably constructed as optical waveguides such as, for example, optical fibers or liquid optical waveguides. Furthermore, the optical waveguides may themselves provide the light needed for the measurement.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or: embodiment of the invention may be incorporated in any other disclosed or described or suggested form or embodiment as a general matter of design choice. It is the intention, therefore, to be limited only as indicated by the scope of the claims appended hereto.

What is claimed is:

1. An apparatus for measuring zonal inking on a printed product having a plurality of inking zones, comprising:

a plurality of optical sensors picking up signals from zonal measurement regions assigned to the plurality of inking zones of the printed product, wherein at least one of:

each of the inking zones of the printed product to be measured is assigned to a respective one of the plural optical sensors, and at least two of the plural inking zones are assigned to a common optical sensor of said plural optical sensors, said common optical sensor being movable along said at least two of the plural inking zones;

at least one optical switch connected for receiving the picked up signals from the plurality of optical sensors; and at least one measurement device connected to said at least one optical switch for receiving the picked up signals and evaluating the picked up signals, wherein the apparatus is disposed in a press for printing the printed product, the apparatus automatically measuring the zonal inking on the printed product during a printing process of the printed product in the press, and said plurality of optical sensors are divided into a plurality of groups of optical sensors, each of said plurality of groups being connected to a respective optical switch, and each said respective optical switch being connected to only a single common measuring device, wherein a further optical switch is connected between each of said respective optical switch and said single common measuring device.

2. The apparatus of claim 1, wherein said measuring device comprises a plurality of subunits which cover different spectral ranges, wherein said at least one optical switch distributes the picked up signals to the subunits, the distribution being wavelength-dependent or wavelength-independent, the measuring device being connected to a control device for supplying the picked up signals to the control device.

3. The apparatus of claim 1, wherein said at least one optical switch comprises only a single common optical switch and said at least one measuring device comprises only a single common measuring device.

4. The apparatus of claim 1, wherein said at least one measuring device evaluates the picked up signals at least one of densitometrically, colorimetrically, or spectrally.

5. The apparatus of claim 1, wherein said optical sensors comprise optical waveguides including optical fibers or liquid optical waveguides.

6. A method for measuring, at an apparatus, the zonal inking on a printed product, comprising the steps of:

assigning at least one of:

each inking zones of a plurality of inking zones of the printed product to be measured to a respective one of a plurality of optical sensors, and at least two of the plural inking zones to a common optical sensor of said plural optical sensors, said common optical sensor being movable along said at least two of the plural inking zones;

picking up signals from zonal measurement regions using a plurality of optical sensors;

passing the picked up signals to a common measuring device with the interposition of at least one optical switch; and measuring, by at least one measuring device, the picked up signals; and evaluating the picked up signals at the measuring device to determine the zonal inking, wherein the apparatus is disposed in a press for printing the printed product, the measuring, at the apparatus, of the zonal inking on the printed product is performed automatically during a printing process of the printed product in the press, and the plurality of optical sensors are divided into a plurality of groups of optical sensors, each of the plurality of groups being connected to a respective optical switch, and each respective optical switch being connected to only a single common measuring device, wherein a further optical switch is connected between each of the respective optical switch and the single common measuring device.

7. The method of claim 6, using the apparatus comprising:

the plurality of optical sensors, each of the optical sensors picking up signals from at least one zonal measurement region assigned to a respective one of the plurality of inking zones of the printed product;

the least one optical switch connected for receiving the picked up signals from the plurality of optical sensors; and the least one measurement device connected to said at least one optical switch for receiving the picked up signals and evaluating the picked up signals.

* * * * *